US005128716A

United States Patent [19]

Kita

[11] Patent Number: 5,128,716

[45] Date of Patent: Jul. 7, 1992

[54] METHOD FOR ADJUSTING A DOCTOR GAP OF A DEVELOPMENT DEVICE IN AN ELECTROPHOTOGRAPHIC PRINTER

[75] Inventor: Masahiro Kita, Tokyo, Japan

[73] Assignee: Asahi Kogaku Kogyo Kabushiki Kaisha, Tokyo, Japan

[21] Appl. No.: 683,551

[22] Filed: Apr. 10, 1991

[30] Foreign Application Priority Data

Apr. 13, 1990 [JP] Japan ..... 2-97881

[51] Int. Cl.[5] ..... G03G 21/00; G03G 15/08

[52] U.S. Cl. ..... 355/203; 118/261; 355/253

[58] Field of Search ..... 355/203, 245, 253, 259, 355/200, 202; 118/261, 653; 33/614, 618, 657

[56] References Cited

U.S. PATENT DOCUMENTS 4,258,372 3/1981 Ishikawa .

FOREIGN PATENT DOCUMENTS 0219859 9/1989 Japan ..... 355/246

0082275 3/1990 Japan ..... 355/245

*Primary Examiner*—A. T. Grimley

*Assistant Examiner*—Matthew S. Smith

*Attorney, Agent, or Firm*—Sandler, Greenblum & Bernstein

[57] ABSTRACT

A method for adjusting a length of a doctor gap of a development device which is employable within an electrophotographic printer. The doctor gap is formed between a circumferential surface of a development roller and an extreme edge of a doctor blade that is arranged to be movable along a radius direction of the development roller. A dummy member, including a circle-shaped part whose radius value is a sum of a radius value of a development roller and the doctor gap is mounted in the development device. A position of the doctor blade along the radius direction is adjusted and fixed at a position at which the doctor blade and the circle-shaped part of the dummy member are in contact with each other. The dummy member is then removed from the development device. Thus, it becomes possible to accurately set a doctor gap with a simple structure, and the outer circumferential surface of the development roller is not scratched.

17 Claims, 4 Drawing Sheets

METHOD FOR ADJUSTING A DOCTOR GAP OF A DEVELOPMENT DEVICE IN AN ELECTROPHOTOGRAPHIC PRINTER

BACKGROUND OF THE INVENTION

The present invention relates to a method of adjusting a doctor gap and an adjustment structure thereof by which the position of a doctor blade is adjusted with respect to a development roller in a development device of an image formation apparatus employing a so-called electrophotographic system, such as an electrophotographic printer.

An image formation apparatus such as an electronic copy machine, a laser printer and the like which uses so-called electrophotographic system is known in which, the image formation apparatus forming an electrostatic latent image by exposing a surface composed of a photoconductive material of a photoconductive drum which has been charged in advance with a predetermined polarity, developing the latent image by adhering toner particles on the photoconductive drum in accordance with the latent image, and transferring the toner image onto a recording medium and fixing the same at a fixing unit paper and fixing the same.

There are various methods of development in the electrophotographic system, but in many cases, a so-called magnetic brush development method is employed, wherein charged toner is adhereed to a multiplicity of magnetic particles and further adhered to an electrostatic latent image when the magnetic particles are contacted with the surface on which the latent image is formed.

The magnetic brush development method employs a so-called two-component developer composed of non-magnetic toner particles and magnetic carrier particles mixed in a predetermined ratio, but recently employed is a so-called 1.5 component development method, wherein a multiplicity of single component charging type magnetic toner particles is used and a magnetic carrier has been adhered in advance to a development roller.

A development device to which the magnetic brush method or the 1.5 component development method is applied in such a manner that a magnetic sleeve is rotatably inserted around the outer circumference of a magnetic roller to form a development roller and the sleeve of the development roller is rotated to sequentially supply toner to a development area, i.e., a contact area of the development roller and the photoconductive drum.

To develop a fine toner image, the height of the magnetic brush, i.e., the thickness of the carrier and toner on the development roller, must be regulated with pinpoint accuracy, and thus a doctor blade is provided in confrontation with the outer circumference of the development roller spaced apart from the outer circumference of the development roller by a predetermined gap, i.e., a doctor gap, thereby regulating the height of the magnetic brush.

The doctor gap is adjusted in such a manner that a flat plate-shaped gauge having the same thickness as that of the doctor gap is held between an outer circumference of the development roller and an extreme end of the doctor blade, and the doctor blade is uniformly pressed and fixed.

However, with the above conventional method of adjusting a doctor gap, the gauge must be horizontally abutted against, or fixed, to the outer circumference of the development roller and the doctor blade must be evenly pressed against the gauge along a longitudinal direction thereof by a uniform force and fixed not to be moved. Thus, a problem arises in that the adjustment operation of the doctor gap is very time consuming and an adjustment with pinpoint accuracy is very difficult.

Further, since the gauge is held between the outer circumference of the development roller and the doctor blade, there is a possibility that the outer circumference of the development roller and the extreme end of the doctor blade will be scratched.

SUMMARY OF THE INVENTION

It is therefore an object of the present invention to provide an improved method for adjusting a doctor gap of a development device wherein a doctor gap can be easily and accurately adjusted, and further, the outer circumference of a development roller is not scratched.

For this purpose, according to the present invention, there is provided a method for adjusting a length of a doctor gap of a development device which is employable within an electrophotographic printer, the doctor gap being formed between a circumferential surface of a development roller and an extreme edge of a doctor blade that is arranged to be movable along a radius direction of the development roller; the method comprising;

mounting a dummy member including a circle-shaped part whose radius value is a sum of a radius value of the development roller and the doctor gap in the development device;

adjusting a position of the doctor blade along the radius direction and fixing so as not to be moved at the position at which the doctor blade and the circumferential surface of the development roller are contacted with each other; and removing the dummy roller from the development device.

DESCRIPTION OF THE ACCOMPANYING DRAWINGS

DESCRIPTION OF THE EMBODIMENTS

Preferring to the drawings of FIG. 1 through 5, an embodiment of the present invention will be described hereinafter.

Figure 1:
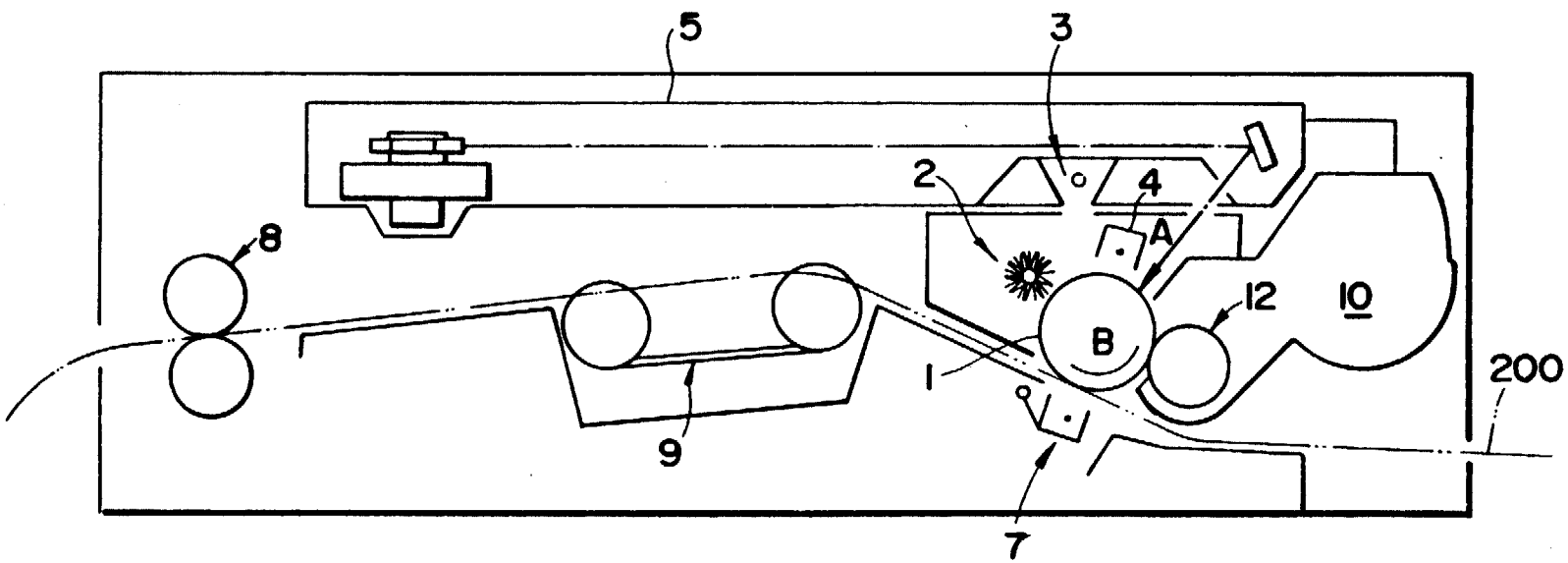
FIG. 1 is a schematic arrangement of a laser beam printer in which a development device whose doctor gap is adjusted by a method according to the present invention can be employed.

FIG. 1 shows a diagram of a schematic arrangement of a laser beam printer. A cleaning unit 2, a discharging unit 3, a charging unit 4, a scanning optical system 5 for introducing a laser beam that is modulated in accordance with image information onto a photoconductive drum 1, as indicated by arrow "A", a development unit 10, and a transfer unit 7 are disposed, respectively, around the photoconductive drum 1 in a rotational direction "B" thereof. Further, a fixing unit 8 is disposed at a downstream side of the photoconductive drum 1 along a feeding path of a continuous-form recording paper 200.

As the photoconductive drum 1 is rotated in the "B" direction, a surface thereof is, first, evenly charged at the charging unit 4 with a predetermined polarity, and is scanned in a lengthwise direction thereof by the laser beam that is modulated in accordance with image data to be developed from the scanning optical system 5. As a result, a latent image, corresponding to the image information to be developed, is formed on the photoconductive drum 1. Toner particles are adhered to the latent image at the development unit 10 to make the latent image visible as a toner image, and the toner image is transferred onto the recording paper 200 that is fed at the speed same as the circumferential speed of the photoconductive drum 1 that is being rotated at the transfer unit 7. The toner image transferred onto the recording paper 200 is heated and pressurized at the fixing unit 8. Thus, the transferred toner image is fixed onto the recording paper 200.

Figure 2:
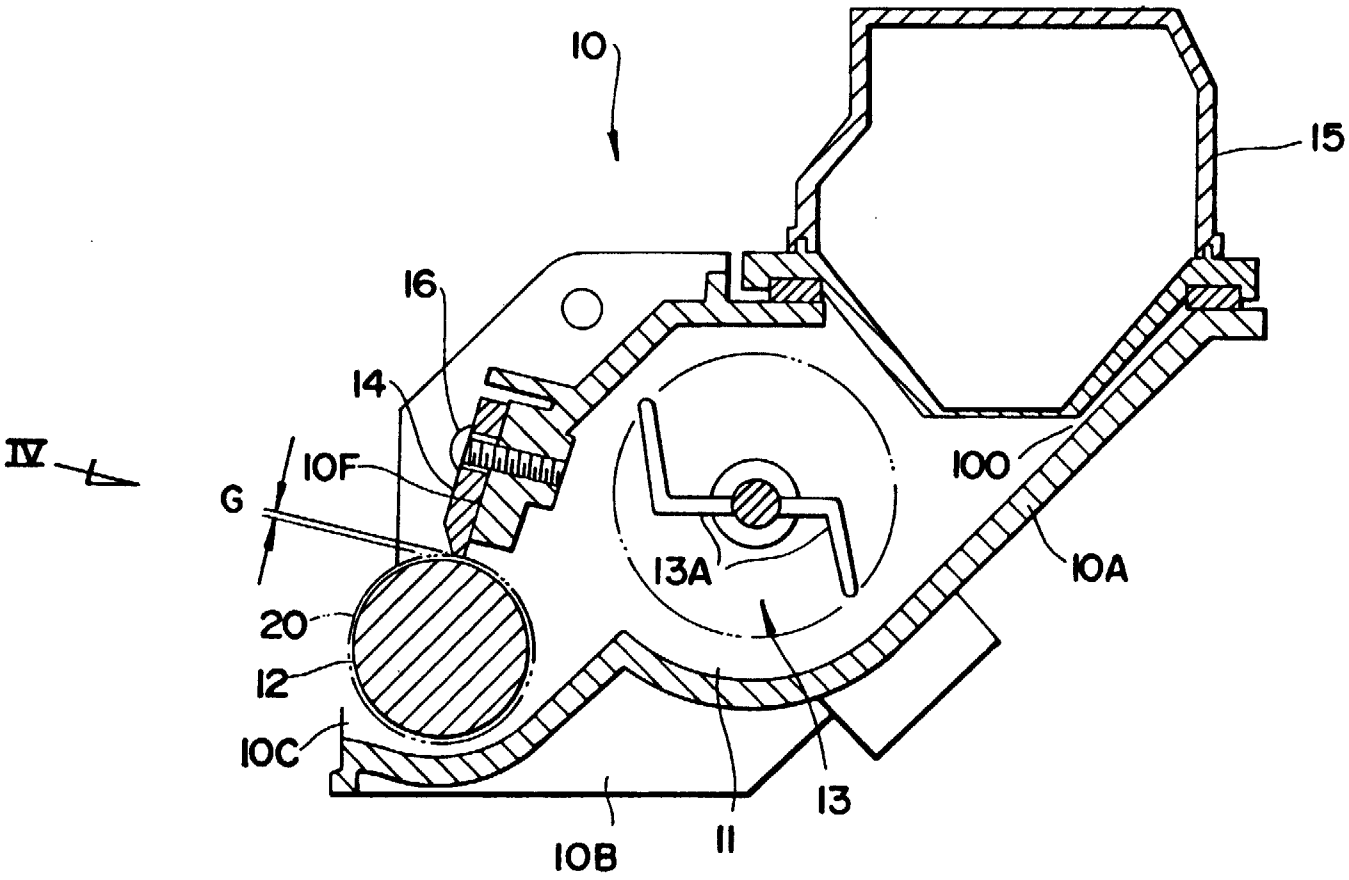
FIG. 2 is a side cross-sectional view of a development device to which a method for adjusting a doctor gap is applied.

FIG. 2 is a side cross-sectional view of a development device to which a doctor gap adjustment structure of the development device according to the present invention is applied. The development device to which the adjustment structure according to the present invention is employed in a 1.5 component development method.

The illustrated development unit 10 comprises a substantially cylindrical toner container 11 formed within a housing 10A, a development roller 12 disposed at an obliquely lower position of the toner container 11, and a toner supply port 100 defined at a position which is the center of symmetry of the development roller 12 and the toner container 11, i.e., at an oblique upper position of a toner container 11. A toner cartridge 15 is mounted on the toner supply port 100.

A scraper 13 includes a plurality of arms 13A, 13A, which rotate to scrape toner particles in the toner container 11 that have been fed from the toner cartridge 15, and feeds the same to the development roller 12. The scraper 13 is located at the center of the toner container 11.

The development roller 12 is held by side housings 10B of the development device 10 at opposite ends thereof and a part of the circumferential surface thereof is exposed from an opening 10C of a housing 10A defined thereto, so that the development roller 12 contacts with the circumferential surface of the photoconductive drum and the toner particles on the circumferential surface of the development roller 12 and are supplied to the photoconductive drum 1 through the opening 10C.

An outer wall surface 10F on the development roller 12 side of the housing 10A which forms the toner container 11 comprises a flat surface that is directed towards the center of the development roller 12 and a doctor blade 14 is mounted there.

The doctor blade 14 is fixed to the outer wall surface 10F by a screw 16. When the doctor blade 14 is moved on the outer wall surface 10F by loosening the screw 16 along a radius direction of the development roller 12, the extreme end thereof advances towards or retracts from the development roller 12 so that a gap "G" a doctor gap, between the extreme end of the doctor blade 14 and the outer circumference of the development roller 12 can be adjusted.

Figure 5:
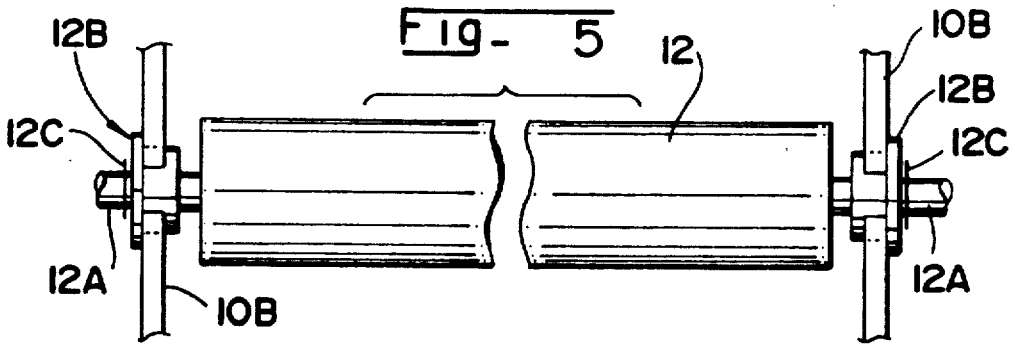
FIG. 5 is a plane view shown from a direction indicated by the arrow (IV) of FIG. 2, wherein a development roller is mounted.

As shown in FIG. 5 which is a cross-sectional view of FIG. 2 taken along arrow (IV), the development roller 12 is supported by the side housings 10B, 10B at the opposite ends thereof through bearings 12B, 12B.

Figure 3:
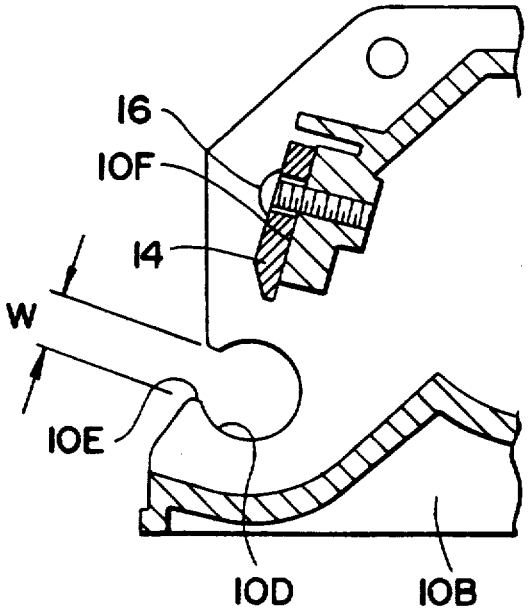
FIG. 3 is a diagram showing the state of FIG. 2 from which a development roller is removed.

As shown in FIG. 3 which indicates the state of FIG. 2 from which the development roller 12 is removed, each of the side housing 10B has a mounting hold 10D defined thereto with which the bearing 12B, 12B are respectively brought into engagement thereto at both side edges. The development roller 12 is rotatably supported by the side housings 10B through the bearings 12B, 12B that engage with the mounting holes 10D.

The mounting hole 10D is connected with the outside through a slit 10E having a predetermined width "W", which is smaller than the diameter of the bearing 12B, 12B to be fitted to the mounting hold 10D.

Figure 4:
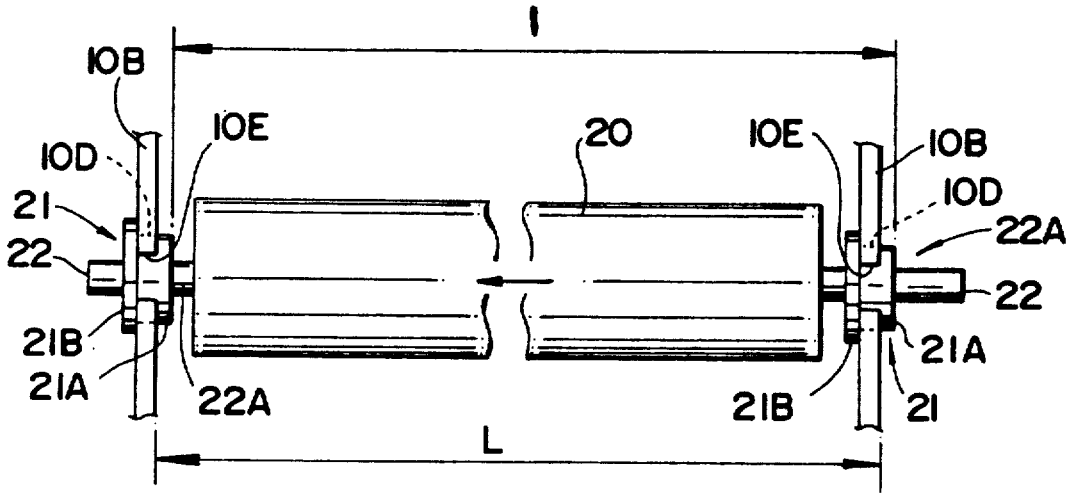
FIG. 4 is a plane view shown from a direction indicated by an arrow (IV) of FIG. 2, wherein a dummy roller is mounted.

When the doctor gap is adjusted, a dummy roller 20, having a radius determined by adding a preset doctor gap to the radius of the development roller 12 is mounted to the mounting holes 10D of the side housings 10B in the same way as in the development roller 12, as shown in FIG. 4 or by an imaginary line in FIG. 2, and the doctor blade 14 is fixed in the state that it abuts against the outer circumference of the dummy roller 20, with a result that the doctor gap can be uniformly adjusted with pinpoint accuracy along the entire lengthwise direction of the doctor blade 14.

The dummy roller 20 has shaft portions 22, 22, which project from the opposite ends thereof, and have a diameter smaller than the width W of the slit 10E of the mounting hole 10D. The dummy roller is provided with bearings 21, 21 similar to those of the development roller 12 fitted thereto, and thus is mounted by causing the bearings 21, 21 to be engaged with the mounting holes 10D.

The bearing 21 has a guard 21B which is formed at one side thereof and has a diameter larger than that of the main body 21A thereof. The bearings 21 are fitted to the shafts 22, 22 with the guards 21B positioned on the same sides. In FIG. 4, the bearings 21, 21 are fitted with the guards 21, 21 positioned on the left sides.

Further, the shaft portions 22, 22 are exposed in a width 22A larger than the thickness of the side housing 10B on the sides opposite to the guards 21B of the bearings 21 and the distance between the exposed shaft portions at the opposite ends "1" is set to be equal to the distance "L" between the side housings 10B, 10B on the opposite sides.

When the doctor gap is to be adjusted, the dummy roller 20 can be easily mounted in such a manner that the exposed shaft portions 22A are caused to be inserted into the mounting hold 10D through the slit 10E of the side housings 10B to position the shaft portions 22 in the mounting holes 10D. Then the dummy roller 20 is moved to the side where the bearings 21 approach the side housings 10B so as to enable the bearing main bodies 21A to be engaged with the mounting holes 10D. Further, the dummy roller 20 can be easily removed by the process opposite to the above by moving the dummy roller 20 in the direction as shown by an arrow in the drawing.

After the doctor gap has been adjusted as described above, the development roller 12 is mounted to the side housings 10B. For example, the development roller 12 is mounted as shown in FIG. 5, in such a manner that the shaft 12A is positioned in the mounting holes 10D through the slits 10E in the state that the bearings 12B are not fitted. The bearings 12B are fitted from the outside of the side housings 10. Then bearing falling out prevention members 12C, such as a retaining ring E-type or the like, are fitted to the outside portions of the shaft 12A adjacent to the bearing 12B.

As described above, according to the method of adjusting a doctor gap of a development device in electrophotographic printer according to the present invention, a dummy roller is mounted to the position where a development roller is to be mounted and a doctor blade is caused to abut against the dummy roller and fixed to thereby adjust the doctor gap, with the result that the doctor blade can be easily adjusted with pinpoint accuracy and the outer circumference of the development roller is not scratched.

Further, as the adjustment structure of the doctor gap, since each of the bearing holding holes where the development roller is mounted has a slit defined thereto which has a width through which the shaft portions of a dummy roller can pass and the bearings of the development roller cannot pass and the dummy roller can be detachably mounted through the slit, the dummy roller can be very easily mounted and dismounted.

The present disclosure relates to subject matter contained in Japanese Patent Application No. HEI 0297881 (filed on Apr. 13, 1990) which is expressly incorporated by reference in its entirety.

What is claimed is:

1. A method for adjusting a length of a doctor gap of a development device which is employable within an electrophotographic printer, the doctor gap being formed between a circumferential surface of a development roller and an extreme edge of a doctor blade that is arranged to be movable along a radius direction of the development roller, said method comprising:

mounting a dummy member having a circle-shaped part whose radius value is a sum of a radius value of the development roller and the doctor gap in the development device;

adjusting a position of the doctor blade along the radius direction and fixing the doctor blade at a position at which the doctor blade and the dummy member are in contact with each other; and removing the dummy member from the development device.

2. The method according to claim 1, wherein the step of mounting the dummy member comprises mounting a cylindrical-shaped dummy roller.

3. The method according to claim 2, wherein the dummy roller includes a roller portion, a pair of shaft portions respectively provided at an outside of the roller portion along a longitudinal direction of the roller portion and a pair of bearing portions provided at an outside of the shaft portions, the dummy roller being arranged to be mounted on a mounting portion having a pair of respective side housings having a slit portion whose length is larger than a diameter of the shaft portions and smaller than a diameter of the bearing portions.

4. The method according to claim 3, further comprising including a pair of guard portions that are associated with the bearing portions and whose diameter is larger than the diameter of the bearing portions, the guard portions being respectively provided at the same side of the pair of bearing portions.

5. The method according to claim 4, comprising having a width length of the side housings along the longitudinal direction of the roller portion being smaller than a length of the shaft portions.

6. A method for adjusting a length of a predetermined gap generated between two predetermined members, at least one member of the two predetermined members having a circle-shaped figure, the predetermined gap being formed between a circumferential surface of one member of the two predetermined members and a second member of the two predetermined members which is arranged to be movable along a radius direction of the one member of the two predetermined members, the method comprising:

mounting a dummy member whose radius value is a sum of a radius value of the one member of the two predetermined members and the predetermined gap;

adjusting a position of the second member of the two predetermined members along the radius direction and fixing the second member of the two predetermined members at a position at which the dummy member and the second member of the two predetermined members are in contact with each other; and removing the dummy member.

7. The method of claim 6, further comprising using a cylindrical-shaped dummy member.

8. The method of claim 6, further comprising mounting the dummy member on a mounting portion that has a pair of respective side housings having a slit portion whose length is larger than a diameter of a pair of shaft portions and smaller than a diameter of a pair of bearing portions.

9. The method of claim 8, further comprising including a pair of guard portions that are associated with the bearing portions and whose diameter is larger than the diameter of the bearing portions.

10. A method for adjusting a length of a doctor gap in a development device, comprising the steps of:

mounting a dummy member in the development device;

adjusting a position of a doctor blade so that the dummy member and the doctor blade are in contact with each other; and removing the dummy member from the development device.

11. The method of claim 10, comprising mounting a dummy roller whose radius is equal to a sum of a radius value of a development roller associated with the development device and the doctor gap.

12. The method of claim 11, further comprising using a cylindrical-shaped dummy roller.

13. The method of claim 10, further comprising mounting the dummy roller on a mounting portion having a pair of respective side housings having a slit portion whose length is larger than a diameter of a pair of shaft portions and small than a diameter of a pair of bearing portions.

14. The method of claim 10, comprising mounting a cylindrical-shaped dummy roller.

15. The method of claim 10, further comprising removing a development roller from the development device prior to mounting the dummy roller in the development device, the dummy roller being mounted in the development device in place of the removed development roller.

16. The method of claim 15, further comprising reinstalling the development roller in the development device after the dummy roller is removed from the development device.

17. The method of claim 10, further comprising inserting a development roller in the development device after the dummy roller is removed.

* * * * *

UNITED STATES PATENT AND TRADEMARK OFFICE

CERTIFICATE OF CORRECTION

PATENT NO. : 5,128,716

DATED : July 7, 1992

INVENTOR(S) : M. KITA

It is certified that error appears in the above-indentified patent and that said Letters Patent is hereby corrected as shown below:

At column 6, line 52 (claim 13, line 5), change "small" to ---smaller---.

Signed and Sealed this

Fifth Day of September, 1995

*Attest:*

*Attesting Officer*

BRUCE LEHMAN

*Commissioner of Patents and Trademarks*